United States Patent [19]

Nilson

[11] 4,153,185

[45] May 8, 1979

[54] PACKAGE FOR FLUIDS AND A METHOD FOR PRODUCING SUCH A PACKAGE

[75] Inventor: Billy N. Nilson, Mjölby, Sweden

[73] Assignee: KeNova AB, Malmo, Sweden

[21] Appl. No.: 683,385

[22] Filed: May 5, 1976

[30] Foreign Application Priority Data

May 6, 1975 [SE] Sweden ..... 7505295

[51] Int. Cl.[2] ..... B65D 35/50

[52] U.S. Cl. ..... 222/212; 222/494

[58] Field of Search ..... 222/206, 213, 214, 494, 222/212

[56] References Cited

U.S. PATENT DOCUMENTS

| | | | |
|---|---|---|---|
| 1,663,677 | 3/1928 | Byerly | 222/206 UX |
| 3,184,121 | 5/1965 | Volckenino | 222/213 |
| 3,662,928 | 5/1972 | Pogorski et al. | 222/214 X |

FOREIGN PATENT DOCUMENTS

| | | | |
|---|---|---|---|
| 269879 | 12/1964 | Australia | 222/206 |
| 426625 | 6/1967 | Switzerland | 222/494 |
| 653136 | 5/1951 | United Kingdom | 222/206 |

*Primary Examiner*—Allen N. Knowles
*Assistant Examiner*—Frederick R. Handren
*Attorney, Agent, or Firm*—Finnegan, Henderson, Farabow & Garrett

[57] ABSTRACT

A package for dispensing fluids including two concave walls interconnected along their peripheries at least one of the walls being flexible and one of the walls having a closure intended to be opened to dispense fluids when the flexible wall is deformed toward the other wall. Preferably, the flexible wall is resilient, tending to snap over to the corresponding convex position, complementing the other wall when the resilient wall is deformed beyond the intermediate position between the walls. Preferably, also the closure is self-closing and positioned in a neck formed in one wall. A removable seal member may be positioned in the neck to protect the self-closing closure.

8 Claims, 8 Drawing Figures

PACKAGE FOR FLUIDS AND A METHOD FOR PRODUCING SUCH A PACKAGE

This invention refers to a package for fluids.

So called sachets intended to be used as expendable packages are previously known. One of the drawbacks with such packages lies in the fact that it is impossible to almost completely empty the package without a considerable effort in time and work and special arrangements. Generally the package has to be provided with an opening to enable fluid to be pressed out therefrom and the content of the package has to be subjected to a pressure for the dispensing and the risk for uncontrolled flow and soiling respectively of opening tools, hands etc. is apparent.

One object of the invention is thus to eliminate these and other drawbacks inherent with packages of the kind referred to.

Another object of the invention is to provide packages of a non-expendable type, i.e. such packages in which only a part of the contents are dispensed at each dispensing operation, whereas the packages between such dispensing operations are to be closed, being aesthetical and handy and the deformation of which, due to the sub-pressure as a consequence of the dispensed fluid-taking place in an attractive manner, and such that the degree of emptying may be clearly observed.

To accomplish these and other objects the invention is carried out according to the claims.

The accompanying drawing illustrates some exemplary embodiments of the invention.

FIG. 1 being a section through a filled expendable package according to the invention, FIG. 2 showing the package as shown in FIG. 1 in an emptied state.

The package illustrated in FIGS. each of 1-8 inclusive comprises two portions 1*a*, 1*b* which in the illustrated embodiment are both made from a relatively thin and flexible material such as a plastic material. However, it must be noted that in order to obtain the desired function it is not necessary to make the two portions thin and flexible but one of the portions may, if desired, be made from a rigid material. The portion 1*a* has an annular flange 2*a* merging into a vaulted part 3*a*, the concave surface of which faces the interior of the package. In the vaulted part 3*a* there is provided an openable part 4 which may comprise an indentation or a weakened area that ruptures or breaks when a predetermined pressure is exerted upon the contents of the package. However, the openable part may also be designed in other ways such as an opening that is initially covered by a removable adhesive tape or the like.

The other portion 1*b* of the package is shaped in an analogous manner, i.e. is provided with an annular flange 2*b* that merges into a vaulted part 3*b* which similarly has the concave surface thereof facing the interior of the package. The portions 1*a*, 1*b* are connected to each other along the inner surfaces of the flanges 2*a*, 2*b* thereof, for example by a heat sealing method or so called plastic welding. Further, the portions are shaped such that they snap from the convex to the concave state by means of their inherent flexibility when one wall is inwardly pressed, and said inwardly pressed wall passes an intermediate position, indicated by the. It will be understood that the matter disclosed above only applies to one wall in case the package includes one rigid and one flexible wall.

Figure 1:
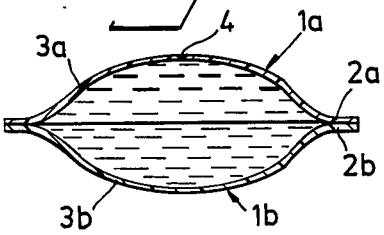
Figure 2:
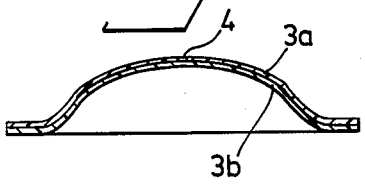

The package described is very easily opened. After exposure of the opening 4, either accomplished by removing the tape or the like, or by rupturing or cutting away a small portion of the wall 3*a*, for example by exerting a pressure upon the content of the package, the dispensing is accomplished without the need for too great a force to be applied upon the package, and when the wall 3*b* has been pressed to a substantially planar position said wall will, as mentioned before, snap to a concave shape, which means that this step of emptying operation generally takes place without exerting any further pressure upon the package. As may be seen in FIG. 2, the wall 3*b* will engage the wall 3*a* and it is understood that as a result thereof an almost complete emptying of the package is obtained. The emptied package further has a small demand for space since several emptied packages may be piled one on the top of the other.

Figure 3:
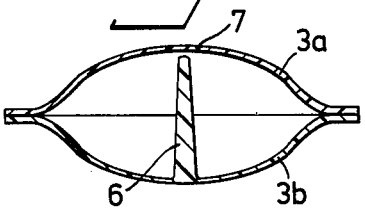
FIG. 3 shows a package as shown in FIG. 1 but provided with a tip to open the package.

In the embodiment shown in FIG. 3 the wall 3*b* to be inwardly pressed is provided with a tip 6 which in the unbroken state of the package has the free end thereof positioned in slight engagement with or at a small distance from a corresponding part of the wall 3*a*. The latter wall is provided with an annular weakened area 7 and it is understood that a circular hole will be formed in the wall 3*a* when the tip is pressed towards the wall portion enclosed by the weakening portion 7 by means of a pressure exerted upon said wall 3*b*. By cooperation between said circular hole and the tip a controlled flow, shaped as a tubular jet, is also obtained.

Figure 4:
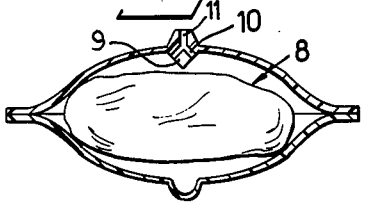
FIG. 4 shows a package provided with an inner sachet-shaped container to be opened by squeezing the package.

In the embodiments previously described the fluid is contained in the interior space 5 of the package and is in intimate contact with the inner surfaces of both portions 1*a*, 1*b*. In cases where the package is intended for such fluids the diffusion of which through the wall of the package cannot be tolerated, it is possible, according to FIG. 4, to enclose the fluid in a sachet 8, for instance made from a metal foil. Said sachet is situated within the package, one wall of which 3*a* having an inwardly directed point 9, provided with channels 10,11 by means of which the interior of the package will communicate with the atmosphere. The wall 3*b* may be provided with a recess 12 in which the point 9 is received in the emptied state of the package. When the described package is subjected to a pressure the point 9 will be pressed against the sachet 8 and will cut a hole therein. The fluid then flows through this hole so that the fluid leaves the package through the channels 10 and 11.

It is understood that by the provision of such a package it is possible to store sensitive compounds such as aetherical oils or the like for prolonged time periods.

As mentioned in the introduction the invention may also be advantageously applied to packages which are not to be emptied at one single occasion.

Figure 5:
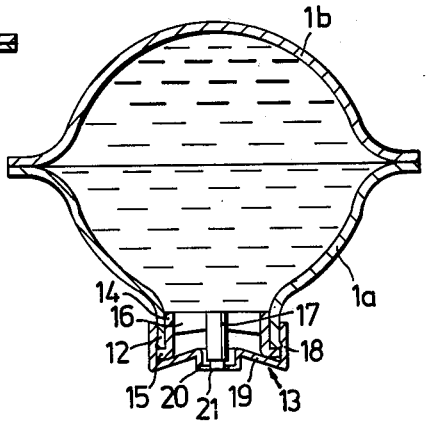
FIG. 5 is a section through a package according to the invention and provided with a self-closing closure.

In the embodiment illustrated in FIG. 5 the package comprises two portions 1*a*, 1*b* one of which being relatively rigid and for instance has a thick-walled portion and a neck part 12 into which a self-closing closure 13 is inserted. The closure 13, known per se, comprises in the embodiment shown an annular element 14 received in the neck part and fixed in the axial direction by an outwardly directed flange 15. Said annular element communicates by means of several radial spokes 16 with a centrally disposed tip 17. The closure also includes a second annular element 18 enclosing the neck part, and from the annular element 18 there projects a wall 19 having such a tiny thickness that it serves as a diaphragm. Said diaphragm defines in the central portion thereof a sleeve 20 with an opening 21 in the end surface thereof and said opening is normally closed by the end of the tip 17. The portion **1*b* is thin-walled and may be shaped similarly to a corresponding wall in the embodiments according to FIGS. 1–4 such that it may snap over from the convex to the concave shape by means of its inherent flexibility but the condition that the closure 13** does not let air into the package makes it unnecessary that the wall in this embodiment should possess this characteristic since the package will gradually collapse depending upon the dispensing of the package contents.

In exerting a pressure upon the package the valve 13 opens and fluid flows out through the opening 21. When said pressure is released the valve closes as mentioned without air entering into the package. The package will therefore be successively collapsed. Said collapsing occurs in the shown embodiment such that the central portion of wall **1*b* successively comes nearer to the central portion of the wall 1*a*, and in the final position the portions 1*a*, 1*b* will occupy the position illustrated in FIG. 2. Preferably the closure 13** is so calibrated that the pressure required to open the actual closure will exceed the force with which the vaulted portion of the package will snap over to the oppositely vaulted shape according to the description above.

Figure 8:
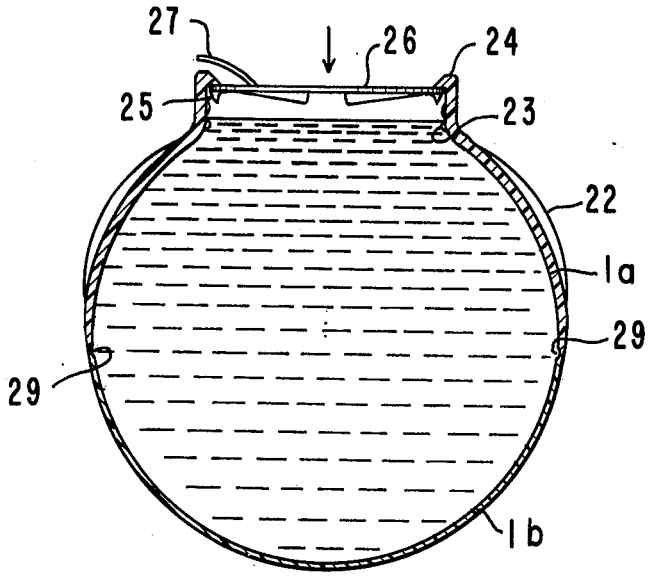
FIG. 8 shows a package having integral walls with a thin-walled portion at the junction of the walls.

In the embodiments described the package comprises two portions which are connected to each other along the inner edge portions of the flanges **22*a*, 2*b* thereof but it is also possible to make the portions 1*a*, 1*b* integral with each other as shown in FIG. 8, but in order to attain the desired function an indentation such as a thin-walled portion 29 must be provided in the transition between the two portions such that a deformation of the portion 1*b*** is achieved.

Figure 6:
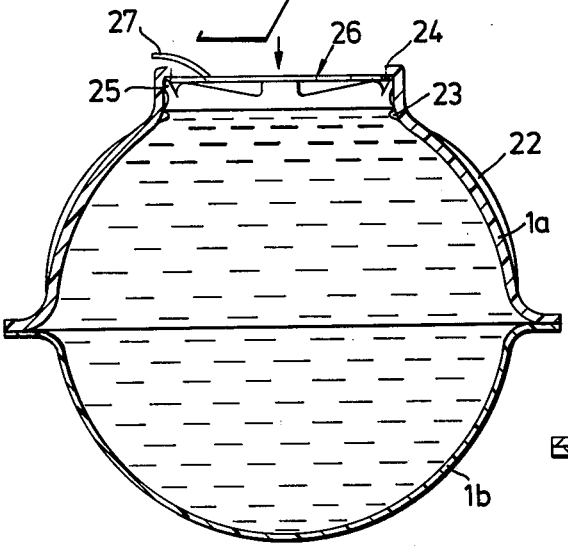
FIG. 6 shows a somewhat modified package.
Figure 7:
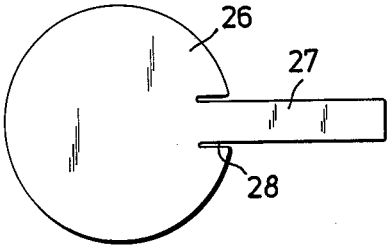
FIG. 7 shows a seal member included in the package shown in FIG. 6.

The package may be made in a rational manner and the invention also refers to a method for producing the package. FIG. 6 illustrates a package made from blow moulded plastic parts. The portion **1*b* is blown in a form and from a thin-walled material while the portion 1*b* has been blown from a somewhat thicker material and in order to obtain further rigidity said portion 1*a* is provided with reinforcement ribs 22 comprising wave shaped or otherwise shaped blow moulded elements 23 in a manner well known in the art. At the transition to the neck part projections such as blow moulded elements 23 are provided for a purpose to be disclosed. The neck terminates in an inwardly directed flange portion 24 which serves to define an abutment surface for a tongue shaped part 25 of the self-closing closure which is of principally the same type as the one shown in FIG. 5 and is therefore not shown in detail. The flange also defines an abutment surface for a seal 26 which according to FIG. 7 comprises a planar part with a substantially circular surface 26 and a tongue 27 projecting therefrom open slots 28 being arranged as shown. In the inserted position this seal prevents the valve from opening and in order to use the package said seal must be removed by pulling the tongue 27**.

By blow moulding part **1*a* the flange 24 will be shaped as a non-perforated wall fully closing the neck opeing and thus the opening must be made by a punching operation. The portions 1*a*, 1*b* are connected to each other by means of a heat sealing method or the like and thereupon the package may be filled through the neck opening. Finally, the self-closing closure is pressed in the direction of the arrow. Said pressing operation is made possible by the flexibility of the tongue-shaped part 25 as well as of the flange 24. When the closure is applicated the seal 26 is pressed thereinto in a corresponding manner. However, the process described is not limited only to include blow moulded parts but may also be applicated to injection moulded or in some other way made parts and further also the sequence of the different steps may be altered. In cases where it is possible to arrange the filling in some other way the portion 1*a*** may also define one part of the self-closing closure and as to the rest the invention may be varied in several respects.

What I claim is:

1. A package for dispensing fluids comprising two concave walls with the concavities facing each other, at least one of said walls being resilient, the force of resiliency tending to snap the deformed wall over to a correspondingly convex shape when deformed toward the other wall beyond a substantially planar position, and one of said walls having a discharge opening with a self-closing closure, said closure opening upon a predetermined pressure of the content of the package on the closure, for dispensing said fluids, said closure substantially preventing the entry of air into said package through said opening; and means interconnecting said walls along the peripheries thereof for permitting at least the major part of the inner surface of a resilient wall to engage the concave surface of the other wall when said resilient wall is deformed by exerting a pressure thereon to such an extent that substantially the entire content of the package is dispensed, said predetermined pressure of said closure being greater than the force of the tendency of said deformed wall to snap over to said convex shape when deformed beyond the substantially planar position, said prevention of air entry and said pressure differential between said closure and said deformed wall force combining to maintain the deformed shape of said package and to allow further controlled dispensing of said fluids.

2. A package according to claim 1 wherein said closure includes a stem and a disphragm having a central aperture interacting with the stem to form a valve and wherein said valve closes when the pressure of said content in said closure is less than said predetermined pressure.

3. A package according to claim 1 wherein said discharge opening includes an outwardly extending flange forming a neck surrounding an aperture, said self-closing closure being positioned in said aperture, and wherein said package includes removable means interacting with said flange for sealing said closure within said neck.

4. A package according to claim 3 wherein the wall including said neck includes means for reinforcing the latter wall.

5. A package according to claim 4 wherein said reinforcing means include ribs for obtaining increased rigidity.

6. A package according to claim 1 wherein said walls include outwardly extending annular flanges and wherein said interconnecting means includes means for sealing together the opposing surfaces of said flanges.

7. A package according to claim 1 wherein said walls are blow-moulded.

8. A package according to claim 1 wherein said walls form an integrated whole and wherein said interconnecting means includes a thin-walled portion at the junction of the walls.

* * * * *